US007718874B2

(12) United States Patent
Cheok

(10) Patent No.: US 7,718,874 B2
(45) Date of Patent: May 18, 2010

(54) GUITAR PICK

(75) Inventor: Ka C. Cheok, 970 Wyman Dr., Waterford, MI (US) 48328

(73) Assignee: Ka C. Cheok, Waterford, MI (US)

( * ) Notice: Subject to any disclaimer, the term of this patent is extended or adjusted under 35 U.S.C. 154(b) by 0 days.

(21) Appl. No.: 12/392,345

(22) Filed: Feb. 25, 2009

(65) Prior Publication Data

US 2009/0217797 A1 Sep. 3, 2009

Related U.S. Application Data

(60) Provisional application No. 61/032,681, filed on Feb. 29, 2008.

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS 2,016,438 A * 10/1935 Kealoha ..... 84/322
3,739,681 A * 6/1973 Dunlop ..... 84/322

* cited by examiner

*Primary Examiner*—Kimberly R Lockett
(74) *Attorney, Agent, or Firm*—Gifford, Krass, Sprinkle, Anderson & Citkowski, P.C.

(57) ABSTRACT

A guitar pick having a planar and generally triangular main body with three sides. Two sides of the main body join in a rounded nose protruding outwardly from one side. A wing extends outwardly from the top of the main body so that at least a portion of the wing lies in a plane oblique to a plane of the main body. The wing may be curvilinear in shape or include plural planar sections.

8 Claims, 2 Drawing Sheets

GUITAR PICK

CROSS REFERENCE TO RELATED APPLICATIONS

This application claims priority of U.S. Provisional Patent Application Ser. No. 61/032,681 filed Feb. 29, 2008, which is incorporated herein by reference.

BACKGROUND OF THE INVENTION

I. Field of The Invention

The present invention relates generally to accessories for music instruments and, more particularly, to a guitar pick.

II. Description of Related Art

Many people enjoy playing the guitar and many of those people use guitar picks when playing the guitar. There are different kinds of picks and the picks are made of different materials. However, one popular pick is a planar pick which is generally triangular in shape. This pick is constructed of a relatively rigid material, such as hard plastic, and is held between the guitar player's thumb and one other finger.

In order to utilize the guitar pick, the guitar player typically holds the guitar pick between the thumb and one of the fingers, typically the index finger, so that one corner of the guitar pick protrudes outwardly from the guitar player's hand. This outwardly protruding corner is then used to strum the guitar strings while using the flat side of the guitar pick to engage and deflect the guitar string to produce the desired note.

Although the flat side is typically used to deflect the guitar strings for many musical pieces, for certain pieces it is desirable to deflect the guitar strings utilizing the edge, rather than the flat side, of the guitar pick. Deflection of the guitar strings utilizing the edge of the guitar pick, rather than the flat side, produces a unique sound which is desirable in some situations.

In order for a guitar player to change from using the flat side of the guitar pick to the edge of the guitar pick during a song, it is necessary with these previously known guitar picks for the guitar player to twist his or her hand into different positions in order to accommodate the desired position of the guitar pick. Such twisting of the guitar player's hand and/or wrist, however, is awkward for many players. Furthermore, it is difficult for many players to play the guitar when his or her hand is oriented in an unnatural position in an effort to reposition the guitar pick.

SUMMARY OF THE PRESENT INVENTION

The present invention provides a guitar pick which overcomes the above-mentioned disadvantages of the previously known guitar picks.

In brief, the guitar pick of the present invention comprises a planar triangular main body having three sides. Two of the sides join in a rounded nose protruding outwardly from one side of the main body. The guitar pick is made from any conventional relatively rigid material, such as plastic.

A wing extends outwardly from the top of the main body so that at least a portion of the wing lies in a plane oblique to a plane of the main body. This wing is preferably arcuate in shape, although it alternatively may be made by adjacent wing sections.

The wing is positioned over the playing finger, such as the index finger, of the guitar player while the guitar player's thumb holds the guitar pick against the playing finger. The wing, furthermore, is dimensioned so that it extends over at least a portion of the playing finger of the guitar player.

With the guitar pick held between the playing finger and the guitar player's thumb, the nose of the main body protrudes outwardly from the player's hand and may be used to deflect the guitar strings and produce the desired notes. However, by simply rolling the guitar pick along the playing finger by the player's thumb, the guitar pick may be positioned so that either the edge or the flat side of the guitar pick deflects the guitar strings and produces the desired note. Furthermore, this repositioning of the guitar pick may be obtained without the necessity of repositioning the player's hand in an awkward or unnatural position.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
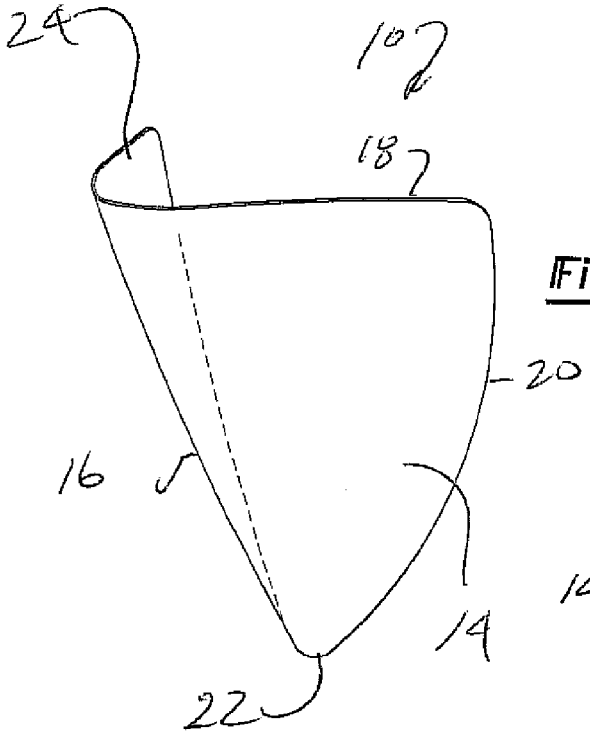
FIG. 1 is an elevational view illustrating a preferred embodiment of the present invention.
Figure 2:
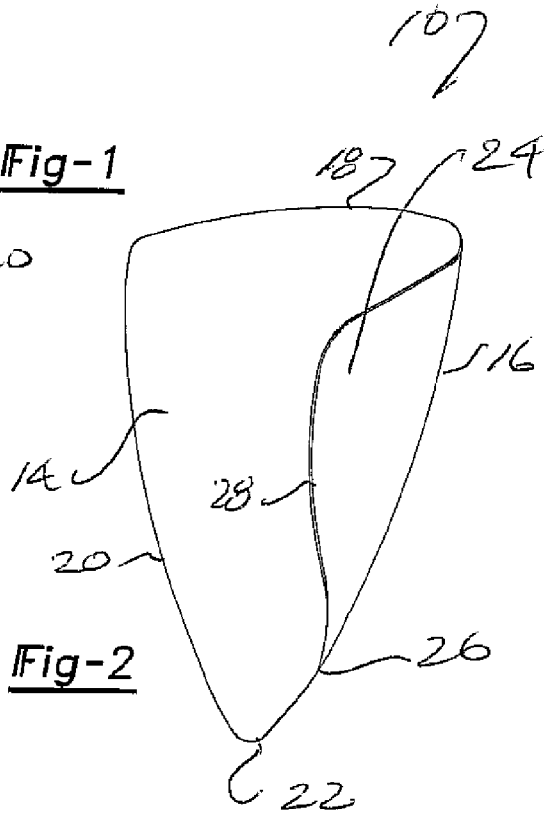
FIG. 2 is an elevational view of the preferred embodiment of the present invention from a different viewing angle.

With reference first to FIGS. 1 and 2, a guitar pick 10 according to the present invention is shown. The guitar pick includes a generally planar main body 14 which is generally triangular in shape and thus has three sides 16, 18 and 20. Two of the sides 16 and 20 join together in a rounded nose 22.

The main body 14 of the guitar pick 10 is generally planar and may be made of any suitable rigid or semi-rigid material, such as plastic. Other materials, such as metal, may alternatively be used.

Figure 3:
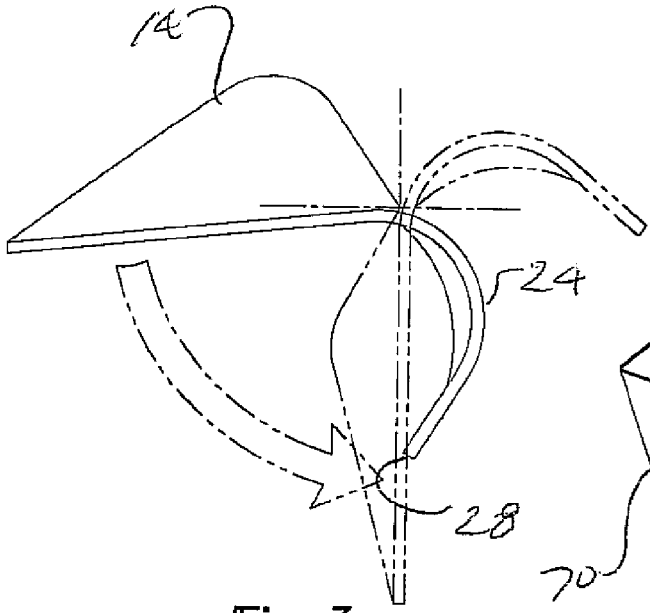
FIG. 3 is an end view illustrating the preferred embodiment of the present invention.

Referring now to FIGS. 1-3, a wing 24 extends outwardly from the side 16 of the main body. This wing 24 extends from the side 18 of the main body and to a position 26 (FIG. 2) which is spaced short of the rounded nose 22. The wing 24 has generally the same thickness as the main body 14, but is curvilinear from the side 16 of the main body 14 and to a free edge 28 of the wing 24. As such, at least a portion of the wing lies in a plane that is oblique to a plane of the main body 14.

Preferably, the main body 14 and the wing 24 are of a one piece construction. Any suitable material, such as plastic, metal or the like, may be used to form the guitar pick 10.

Figure 5:
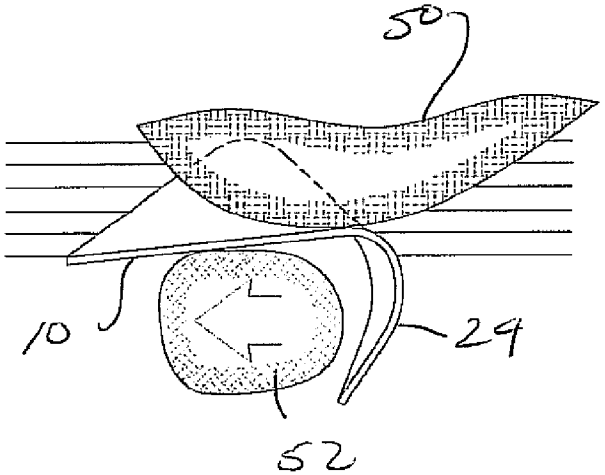
FIG. 5 is a sectional view taken substantially along line 5-5 in FIG. 4 and enlarged for clarity.
Figure 4:
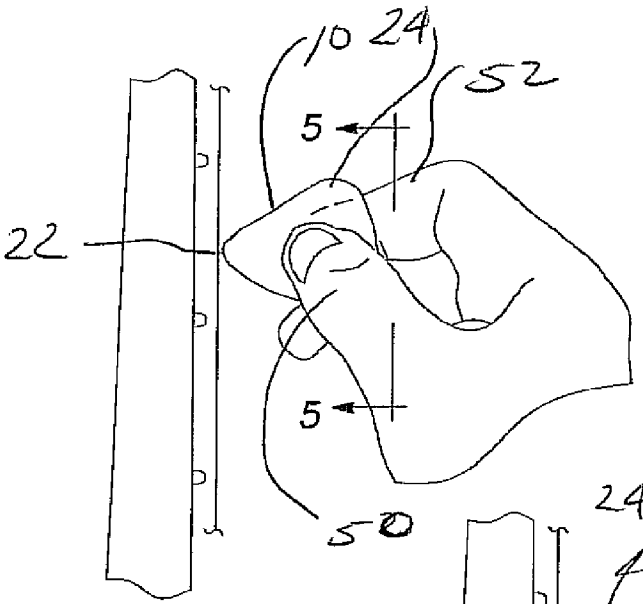
FIG. 4 is a side fragmentary view illustrating the pick positioned in one configuration.

With reference now to FIGS. 4 and 5, the guitar pick 10 is there shown held between a thumb 50 and playing finger 52, such as the index finger, of a guitar player. As shown in FIG. 4, the rounded nose 22 is oriented so that a flat side of the rounded nose 22 contacts and deflects one or more strings 54 on a guitar 56 when played. In this position, the wing 24 (see FIG. 5) extends over a portion of the playing finger 52 of the guitar player.

Figure 7:
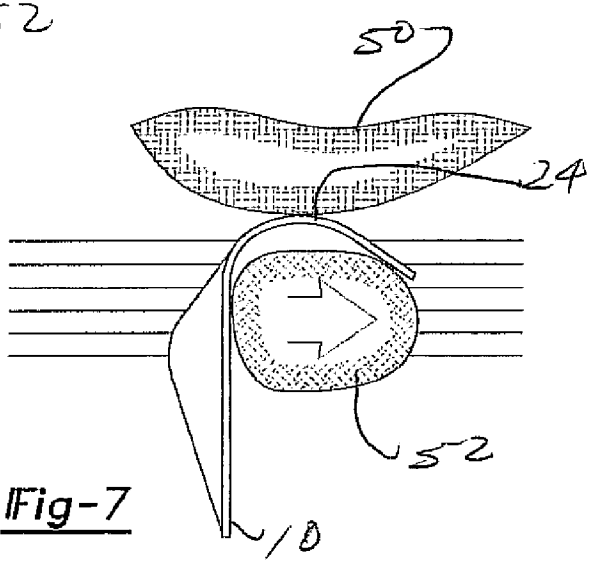
FIG. 7 is a fragmentary sectional view taken substantially along line 7-7 in FIG. 6 and enlarged for clarity.
Figure 6:
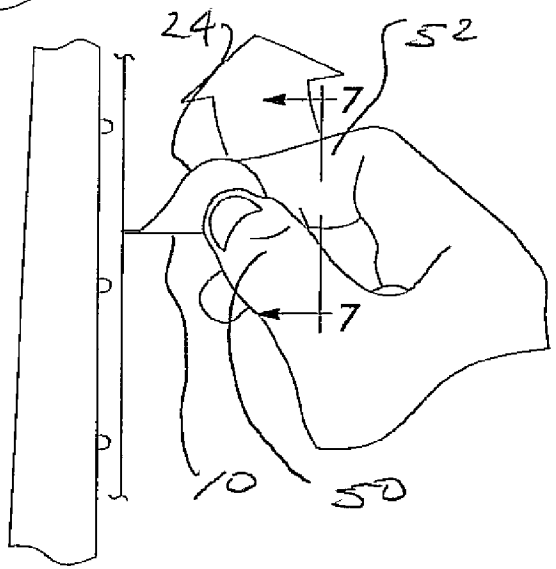
FIG. 6 is a view similar to FIG. 4 but illustrating the guitar pick in a second configuration.

With reference now to FIGS. 6 and 7, the guitar player may change the position of the guitar pick 10 so that an edge 60 of the guitar pick 10 registers with and deflects the strings 54 of the guitar 56. The guitar pick 10 may be positioned as shown in FIGS. 6 and 7 by a combined movement of the thumb 50 and index finger 52 thus rotating the wing 24 about the playing finger 52 which simultaneously rotates the guitar pick 14 by approximately ninety degrees. Similarly, the guitar pick may be changed back to the position shown in FIGS. 4 and 5 by merely reversing the movement of the player's thumb 50.

As is well known, the guitar exhibits a different sound or playing characteristics when the flat side of the guitar pick is used to deflect the guitar strings 54 than when the edge 60 of the guitar pick is used to deflect the strings 54. Consequently, with the instant invention, the guitar player may rapidly change between either desired sound characteristic.

Figure 8:
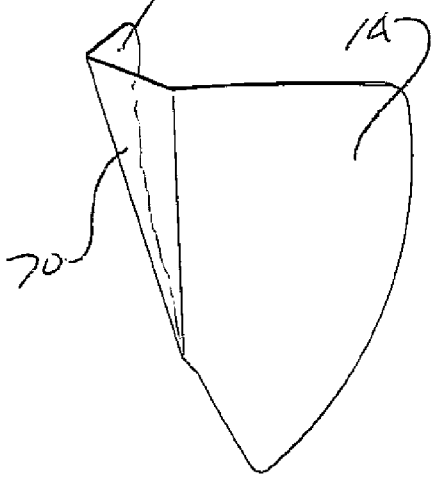
FIG. 8 is a view similar to FIG. 1, but illustrating a second preferred embodiment of the present invention.

With reference now to FIG. 8, a second preferred embodiment of the present invention is shown in which the arcuate wing 24 is replaced by two wing sections 70 and 72, both of which are planar. These wing sections 70 and 72 each have a plane that is oblique not only to the plane of the main body 14, but also to each other.

Although the pick 10 has been described as a guitar pick, it will be understood that the pick may be used on any string instrument.

From the foregoing, it can be seen that the present invention provides a simple and yet highly effective guitar pick especially useful for changing the position of the pick relative to the guitar strings in use. Having described my invention, however, many modifications thereto will become apparent to those skilled in the art to which it pertains without deviation from the spirit of the invention as defined by the scope of the appended claims.

I claim:

1. An instrument pick comprising:

a planar and generally triangular shaped main body having a first and a second side and a rounded nose formed at a junction at a first end of said first and second sides, said body having a third side which joins a second end of said first and second sides, a wing joined to and extending outwardly from only said first side of said main body so that at least a portion of said wing lies in a plane oblique to a plane of said main body, wherein said wing extends along said first side from said third side of said main body and to a point adjacent said rounded nose.

2. The invention as defined in claim 1 where said main body and said wing are of a one piece construction.

3. The invention as defined in claim 1 wherein said wing has a thickness substantially the same as said main body.

4. The invention as defined in claim 2 wherein said main body and said wing are constructed of a rigid material.

5. The invention as defined in claim 1 wherein said wing has a height extending outwardly from said top of said main body equal substantially to a diameter of an adult index finger.

6. The invention as defined in claim 1 wherein said wing extends outwardly from said top of said main body in a continuous arc.

7. The invention as defined in claim 1 wherein said wing includes two lateral sections which intersect each other at an oblique angle.

8. The invention as defined in claim 7 wherein one lateral section intersects said top of said main body at an oblique angle.

* * * * *